US008701436B2

(12) United States Patent
Kim

(10) Patent No.: US 8,701,436 B2
(45) Date of Patent: Apr. 22, 2014

(54) PIVOTABLE WATER DISPENSER FOR A REFRIGERATOR DOOR

(75) Inventor: Hyeon Jin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1617 days.

(21) Appl. No.: 12/142,607

(22) Filed: Jun. 19, 2008

(65) Prior Publication Data

US 2008/0314065 A1 Dec. 25, 2008

(30) Foreign Application Priority Data

Jun. 20, 2007 (KR) ..... 10-2007-0060210
Jun. 20, 2007 (KR) ..... 10-2007-0060211

(51) Int. Cl.

| | |
|---|---|
| ***F25D 3/00*** | (2006.01) |
| ***F25D 19/00*** | (2006.01) |
| ***B65B 1/04*** | (2006.01) |
| ***B67D 7/84*** | (2010.01) |
| ***B67D 1/16*** | (2006.01) |
| ***B67D 3/00*** | (2006.01) |
| ***B67D 7/06*** | (2010.01) |

(52) U.S. Cl.

USPC ..... 62/389; 62/449; 62/390; 62/391; 141/362; 222/167; 222/533; 222/534; 222/108

(58) Field of Classification Search

USPC ..... 62/389, 449; 222/108, 529, 530, 222/533–536; 141/362

See application file for complete search history.

(56) References Cited

U.S. PATENT DOCUMENTS

| | | | | |
|---|---|---|---|---|
| 1,930,233 | A * | 10/1933 | Feltault | 366/261 |
| 2,744,390 | A * | 5/1956 | Partsch | 62/138 |
| 3,426,944 | A * | 2/1969 | French | 222/129 |
| 3,476,295 | A * | 11/1969 | Telfer | 222/183 |
| 4,227,383 | A * | 10/1980 | Horvay | 62/344 |
| 5,797,524 | A * | 8/1998 | Lentz | 222/505 |
| 6,135,173 | A * | 10/2000 | Lee et al. | 141/361 |
| 6,425,425 | B2 * | 7/2002 | Bianchi et al. | 141/362 |
| 6,692,093 | B1 * | 2/2004 | Park et al. | 312/405.1 |
| 7,007,500 | B2 * | 3/2006 | Lee | 62/389 |
| 7,059,693 | B2 * | 6/2006 | Park | 312/405.1 |
| 7,108,342 | B2 * | 9/2006 | Shin et al. | 312/405 |
| 7,201,005 | B2 * | 4/2007 | Voglewede et al. | 62/126 |
| 7,455,085 | B2 * | 11/2008 | Voglewede et al. | 141/360 |
| 7,713,090 | B2 * | 5/2010 | Kendall et al. | 439/628 |
| 2003/0097314 | A1 * | 5/2003 | Crisp et al. | 705/28 |
| 2005/0268638 | A1 | 12/2005 | Voglewede et al. | |
| 2007/0289669 | A1 * | 12/2007 | An et al. | 141/362 |

FOREIGN PATENT DOCUMENTS

| | | | |
|---|---|---|---|
| KR | 10-2004-0042965 | A | 5/2004 |
| KR | 10-2005-0028360 | A | 3/2005 |
| KR | 10-0504917 | B1 | 8/2005 |
| KR | 10-0510698 | B1 | 8/2005 |

* cited by examiner

*Primary Examiner* — Allen Flanigan
*Assistant Examiner* — Filip Zec
(74) *Attorney, Agent, or Firm* — Birch, Stewart, Kolasch & Birch, LLP

(57) ABSTRACT

A refrigerator is provided to prevent sustaining of injuries by users, and which is capable of being hygienically used. The refrigerator prevents users sustaining injuries from inadvertently bumping into a dispenser or a tray when passing by the refrigerator.

21 Claims, 8 Drawing Sheets

PIVOTABLE WATER DISPENSER FOR A REFRIGERATOR DOOR

CROSS-REFERENCE TO RELATED APPLICATIONS

The present application claims priority under 35 U.S.C. 119 and 35 U.S.C. 365 to Korean Patent Application No. 10-2007-0060210, 10-2007-0060211 (filed on Jun. 20, 2007), which is hereby incorporated by reference in its entirety.

BACKGROUND

The present disclosure relates to a refrigerator.

In general, a refrigerator is an apparatus that supplies cold air to storage compartments to maintain food at low temperatures. A water tank is disposed inside the refrigerator, and a dispenser connected to the water tank is disposed in a door of the refrigerator. The dispenser is formed recessed into the door, or projects outward from the door. Accordingly, a user is able to dispense potable water from the water tank through the dispenser without having to open the door. Also, a tray is disposed at the bottom of the dispenser to allow water remaining in a cup to be discarded. The tray is disposed projecting outward from the door.

However, when the dispenser and tray are disposed to project outward from the door, an inattentive user can sustain an injury from bumping into the dispenser or tray while passing by the refrigerator.

Also, when the dispenser and tray are exposed to the outside, the inlet for the water supply tube of the dispenser is contaminated by impurities. Moreover, because the tray holds water discarded by users, the water stored in the tray can fester and foul interior compartments and the drain outlet of the dispenser.

In addition, design freedom for refrigerators is severely restricted and aesthetics are compromised by externally exposing the dispenser and tray.

SUMMARY

Embodiments provide a refrigerator that can obviate the danger of users sustaining injury from a dispenser and tray structure, that can be used under sanitary conditions, and that can increase freedom in refrigerator design.

In one embodiment, a refrigerator includes: a main body with a storage compartment within; a door pivotably coupled to a front of the main body; a dispenser withdrawably provided at a front surface of the door; a water supply tube extending to a bottom end of the dispenser, to dispense potable water; and a driving mechanism driving the dispenser.

In another embodiment, a refrigerator includes: a main body with a storage compartment within; a door pivotably coupled to a front of the main body; a dispenser pivotably provided at a front surface of the door; a water supply tube extending to a bottom of the dispenser; and a dispensing lever pivotably provided at the bottom of the dispenser.

In a further embodiment, a refrigerator includes: a main body with a storage compartment within; a door pivotably coupled to a front of the main body; a dispenser withdrawably provided at a front surface of the door; a tray provided below the dispenser to be forwardly withdrawable; and a driving mechanism for driving the tray.

In a still further embodiment, a refrigerator includes: a main body with a storage compartment within; a door pivotably coupled to a front of the main body; a dispenser withdrawably provided at a front surface of the door; a tray provided below the dispenser, to be forwardly withdrawable; and a control unit for inputting operating commands for the dispenser and/or the tray.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
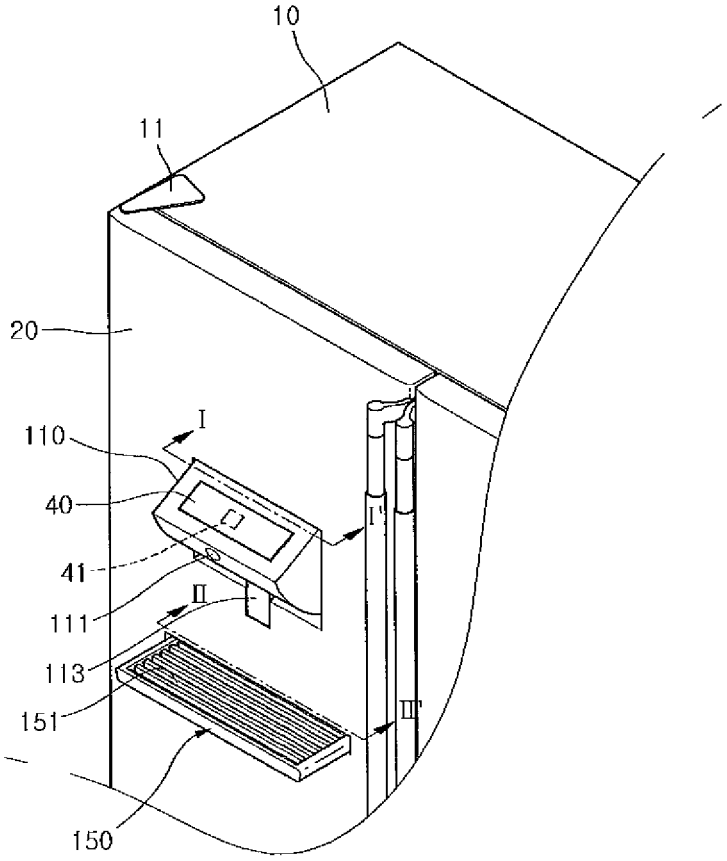
FIG. 1 is a perspective view of a refrigerator according to embodiments of the present disclosure.

FIG. 1 is a perspective view of a refrigerator according to embodiments of the present disclosure.

Referring to FIG. 1, the refrigerator includes a main body 10 and a door 20. The door 20 opens and closes a storage compartment defined in the main body 10. The door 20 is pivotably installed on the main body 10 through a hinge portion 11. Also, a water tank 30 is disposed in the storage compartment of the main body 10.

The door 20 has a withdrawable dispenser 110 disposed thereon. The dispenser 110 includes a water supply tube 111 for dispensing potable water, and a dispensing lever 113 for inputting a command to dispense potable water.

A control unit 40 is disposed on the front surface of the dispenser 110. A touch screen with a plurality of buttons 41 or touch button(s) may be applied to the control unit 40. Here, when a user presses the touch screen or a touch button, the display is barely pressed, so that the dispenser 110 is prevented from being automatically withdrawn from a vertical position.

A tray 150 is withdrawably disposed below the dispenser 110. In detail, the tray 150 is formed of an outer tray 153, a removable inner tray 152 held within the outer tray 153, and a grill portion 151 detachably provided atop the inner tray 152. Discarded water or water that drops from the water supply tube 111 descends through through-holes defined in the grill portion 151, and a water tank for storing water is defined in the inner tray 152. Here, the grill portion 151 and the inner tray 152 can be removed together.

Figure 2:
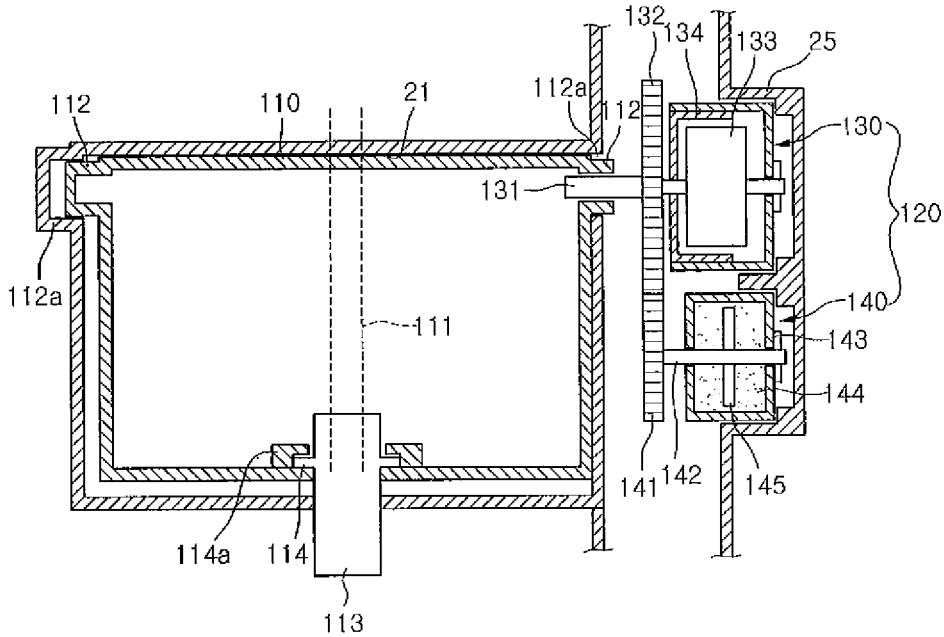
FIG. 2 is a sectional view of FIG. 1 taken along line I-I' showing a dispenser and driving mechanism according to a first embodiment of the present disclosure.
Figure 3:
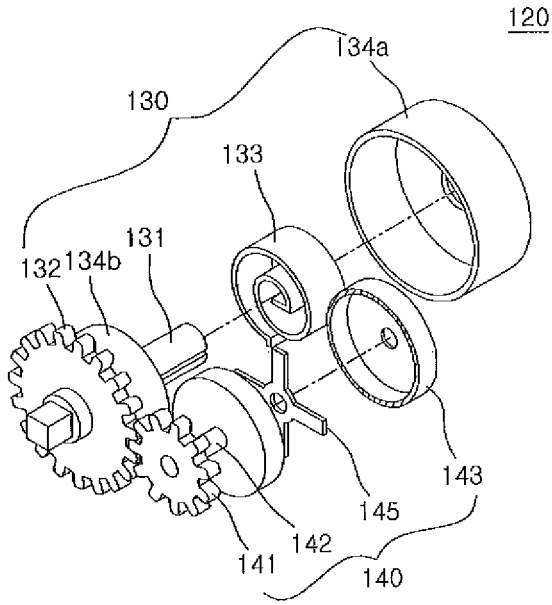
FIG. 3 is an exploded perspective view of an opening/closing unit for a dispenser.

FIG. 2 is a sectional view of FIG. 1 taken along line I-I' If showing a dispenser and driving mechanism according to a first embodiment of the present disclosure, and FIG. 3 is an exploded perspective view of an opening/closing unit for a dispenser.

Referring to FIGS. 2 and 3, the dispenser 110 is pivotably coupled through a hinge to the door 20. Here, a housing 21 is defined in the door 20 to hold the dispenser 110. Also, hinge portions 112 are formed on either side at the upper portion of the dispenser 110, and hinge receivers 112*a* are defined at either side of the housing 21 to correspond to the hinge portions 112. Thus, the dispenser 110 pivots about the hinge portions 112 to withdraw the lower portion forward.

The dispensing lever 113 is pivotably disposed at a lower surface of the dispenser 110. The dispensing lever 113 has a hinge axis 114 formed on either side thereof, and the lower surface of the dispenser has hinge receivers 114*a* formed to receive the hinge axes 114 of the dispensing lever 113 pivotably coupled thereto. Here, the hinge axes 114 are formed eccentrically upward from a transverse, vertically halving line on the dispensing lever 113. That is, the hinge axes 114 are formed closer to the upper end of the dispensing lever 113. Accordingly, when the dispenser 110 is pivoted and withdrawn forward, the dispensing lever 113 is pivoted downward by its moment. Thus, the dispensing lever 113 is disposed at close to an upright position. This will be described in more detail below.

A driving mechanism 120 for supplying withdrawing force to the dispenser 110 is provided inside the door 20. The driving mechanism 120 may include a rotating unit 130 that supplies rotational force to the dispenser 110, and a damping unit 140 that reduces the rotating speed of the dispenser 110.

The rotating unit 130 may include a driving shaft 131 coupled to a hinge portion 112 at one side of the dispenser 110, a driving gear 132 coupled to the driving shaft 131, and an elastic member 133 imparting elasticity to the driving shaft 131. The driving shaft 131 is passed through a case 134, and connected to the elastic member 133 housed within the case 134. Here, the case 134 may be formed of a rear case 134*a* and a front case 134*b*. The elastic member 133 may be a clock spring. Accordingly, elastic energy stored in the clock spring is transferred to the driving shaft 131 and converted to rotational force that rotates the driving shaft 131.

The damping unit 140 may include a damping gear 141 engaged with the driving gear 132, a driven shaft 142 coupled to the axis of the damping gear 141, a fluid housing 143 through which the driven shaft 142 is passed and which houses a viscous fluid 144 within, and a blade 145 rotatably coupled to the driven shaft 142 and disposed in the fluid housing 143. Here, the damping unit 140 may employ a clock spring that imparts an elastic force in the direction opposite that of the elastic member 133 of the rotating unit 130, instead of employing the viscous fluid. In this case, the clock spring of the damping unit 140 may have an elastic bias less than the elastic member 133 of the rotating unit 130

Here, when the elastic member 133 imparts rotational force on the driving shaft 131 and the driving gear 132, the viscous fluid 144 reduces the rotational force of the blade 145, so that the damping gear 141 damps the rotational force of the driving gear 132. Resultantly, the elastic member 133 and the viscous fluid 144 simultaneously impart withdrawing force and resisting force on the dispenser 110. Accordingly, the dispenser 110 is not withdrawn at a high speed, but can be smoothly withdrawn at a virtually constant speed.

Also, the case 134 of the rotating unit 130 and the fluid housing 143 of the damping unit 140 are fixed to fixing portions 25 and 26 formed in the door 20.

Figure 4:
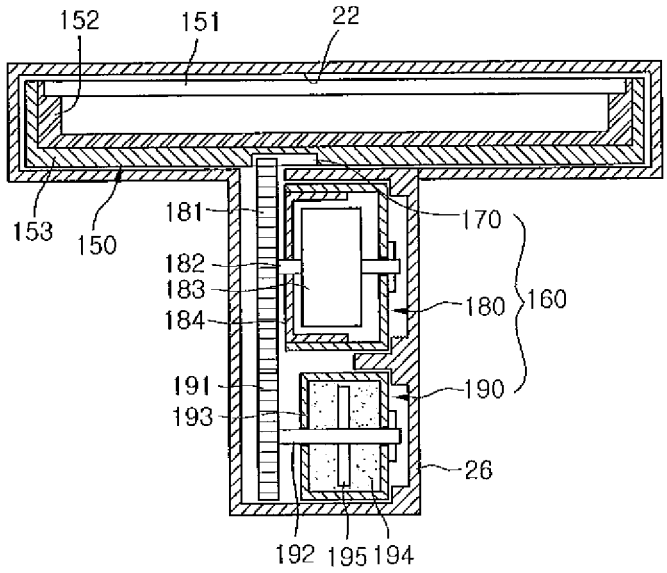
FIG. 4 is a sectional view of FIG. 1 taken along line II-II' showing a tray and withdrawing unit according to the first embodiment of the present disclosure.

FIG. 4 is a sectional view of FIG. 1 taken along line II-II' showing a tray and withdrawing unit according to the first embodiment of the present disclosure.

Referring to FIG. 4, the tray 150 is housed such that is can move in a transverse direction to the door 20. In other words, the tray 150 is provided to be horizontally withdrawable forward from the door 20 or inserted into the door 20. The door defines a receiving space 22 within to receive the tray 150. A driving mechanism 160 for driving the tray 150 is disposed below or above the tray 150.

The driving mechanism 160 may include a rack gear 170 formed in the undersurface of the tray 150, a withdrawing unit 180 engaged with the rack gear 170 to withdraw and insert the tray 150, and a damping unit 190 to reduce the withdrawn speed of the tray 150.

The rack gear 170 is configured as a flat gear disposed from front-to-rear on the tray 150. That is, the rack gear 170 is defined from front-to-rear in the undersurface of the outer tray 153.

The withdrawing unit 180 may include a driving gear 181 engaged to the rack gear 170, a driving shaft 182 coupled to the axis of the driving gear 181, and an elastic member 183 imparting elastic force to the driving shaft 182. Here, the withdrawing unit 180 may be configured in the same way as the rotating unit 130 that drives the dispenser 110. That is, the driving shaft 182 may be inserted through a case 184, and the elastic member 183 may be housed inside the case 184. Also, the driving shaft 182 may be connected to the elastic member 183, and the elastic member 183 may be a clock spring.

The damping unit 190 may be configured in the same way as the damping unit 140 configuring the driving mechanism 120 of the dispenser 110. Specifically, the damping unit 190 may include a damping gear 191 engaged with the driving gear 181, a driven shaft 192 coupled to the axis of the damping gear 191, a fluid housing 193 having the driven shaft 192 inserted therethrough and holding a viscous fluid 194, and a blade 195 rotatably coupled to the driven shaft 192 and disposed in the fluid housing 193. Here, instead of employing the viscous fluid 194, the damping unit 190 may employ a clock spring that imparts an elastic force in the direction opposite that of the elastic member 183 of the withdrawing unit 180. In this case, the clock spring of the damping unit 190 may have an elastic bias less than the elastic member 183 of the withdrawing unit 180.

In the above configuration, when the elastic member 183 of the withdrawing unit 180 imparts rotational force on the driving shaft 182 and the driving gear 181, the viscous fluid 194 damps the rotational force of the blade 195. Accordingly, the damping gear 191 reduces the rotational force of the driving gear 181. Thus, the elastic member 183 and the viscous fluid 194 simultaneously impart withdrawing force and resistance on the tray 150, so that the tray 150 is not withdrawn at high speed and can be withdrawn smoothly at a virtually constant speed.

The case 184 of the withdrawing unit 180 and the fluid housing 193 of the damping unit 190 are fixed to fixing portions 25 and 26 formed in the door 20.

Figure 5:
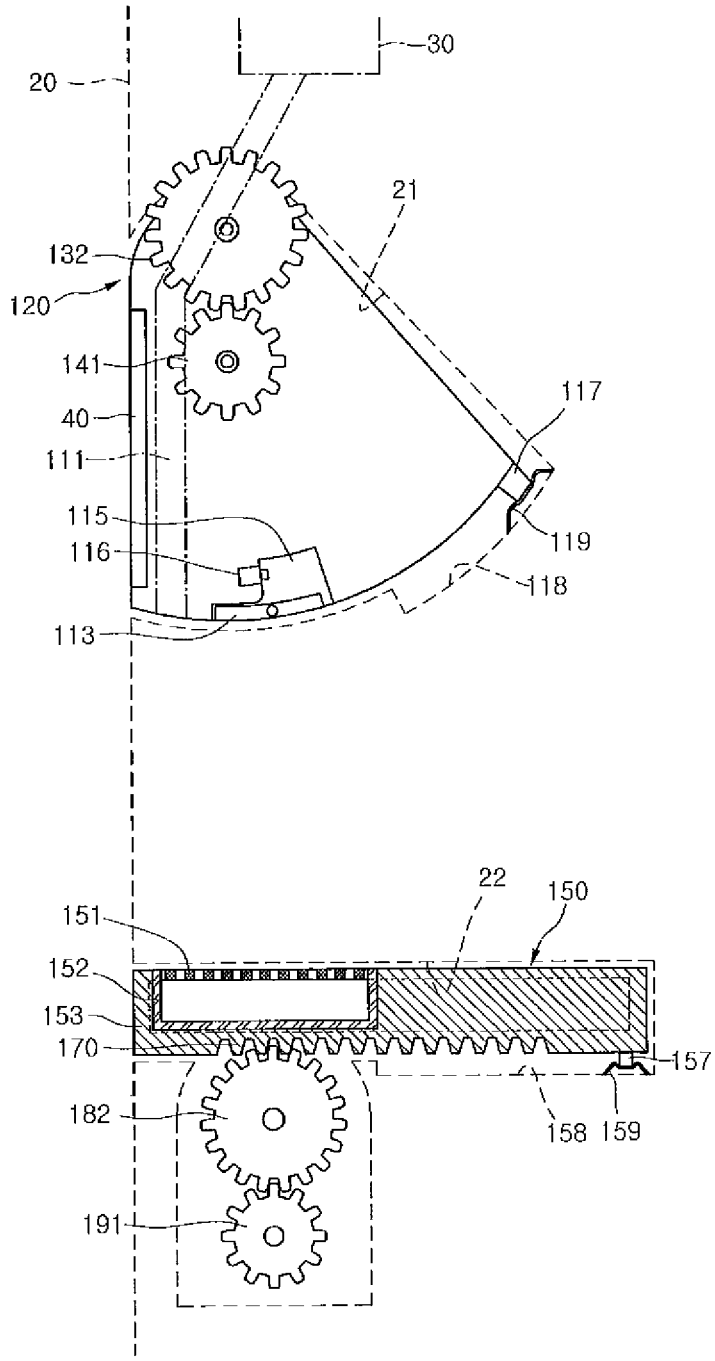
FIG. 5 is cross-sectional view showing a dispenser and tray structure of a refrigerator according to the first embodiment of the present disclosure.

FIG. 5 is cross-sectional view showing a dispenser and tray structure of a refrigerator according to the first embodiment of the present disclosure.

Referring to FIG. 5, a pivoting space 115 is defined in the lower surface of the dispenser 110 to enable the dispensing lever 113 to pivot. A switch 116 is disposed at the front of the pivoting space 115. The switch 116 transmits a signal to a controller (not shown) to dispense potable water when the dispensing lever 113 is pressed. Accordingly, the controller dispenses water from the water tank 30 through the water supply tube 111 to the outside.

A protrusion 117 is formed on the lower surface of the dispenser 110 to restrict the withdrawn distance of the dispenser 110. A slot 118 is defined in the floor of the housing 21 formed in the door 20, to allow the protrusion 117 of the dispenser 110 to move therein. A catch 119 is provided at the rear portion of the slot 118 to restrict the protrusion 117 of the dispenser 110 when the dispenser 110 is inserted. The catch 119 restricts the protrusion 117 so that the dispenser 110 is not pivoted when elastic force from the elastic member 133 is imparted on the dispenser 110. That is, a restrictive force between the catch 119 and the protrusion 117 is maintained to be greater than the elastic force of the elastic member 133.

A protrusion 157 is also formed on the lower surface at the rear of the tray 150, to restrict the withdrawn distance of the tray 150. A slot 158 is defined in the floor in the receiving space 22 that receives the tray 150, to allow movement of the protrusion 157 within a predetermined range. A catch 159 is provided at the rear portion of the slot 158 to restrict the protrusion 157 of the tray 150 when the tray 150 is inserted. The catch 159 restricts the protrusion 157 to prevent the tray 150 from being withdrawn even when elastic force from the elastic member 183 of the withdrawing unit 180 is imparted on the tray 150. Here, the relation between the protrusion 117 and the catch 119 may be said to be the same.

Figure 6:
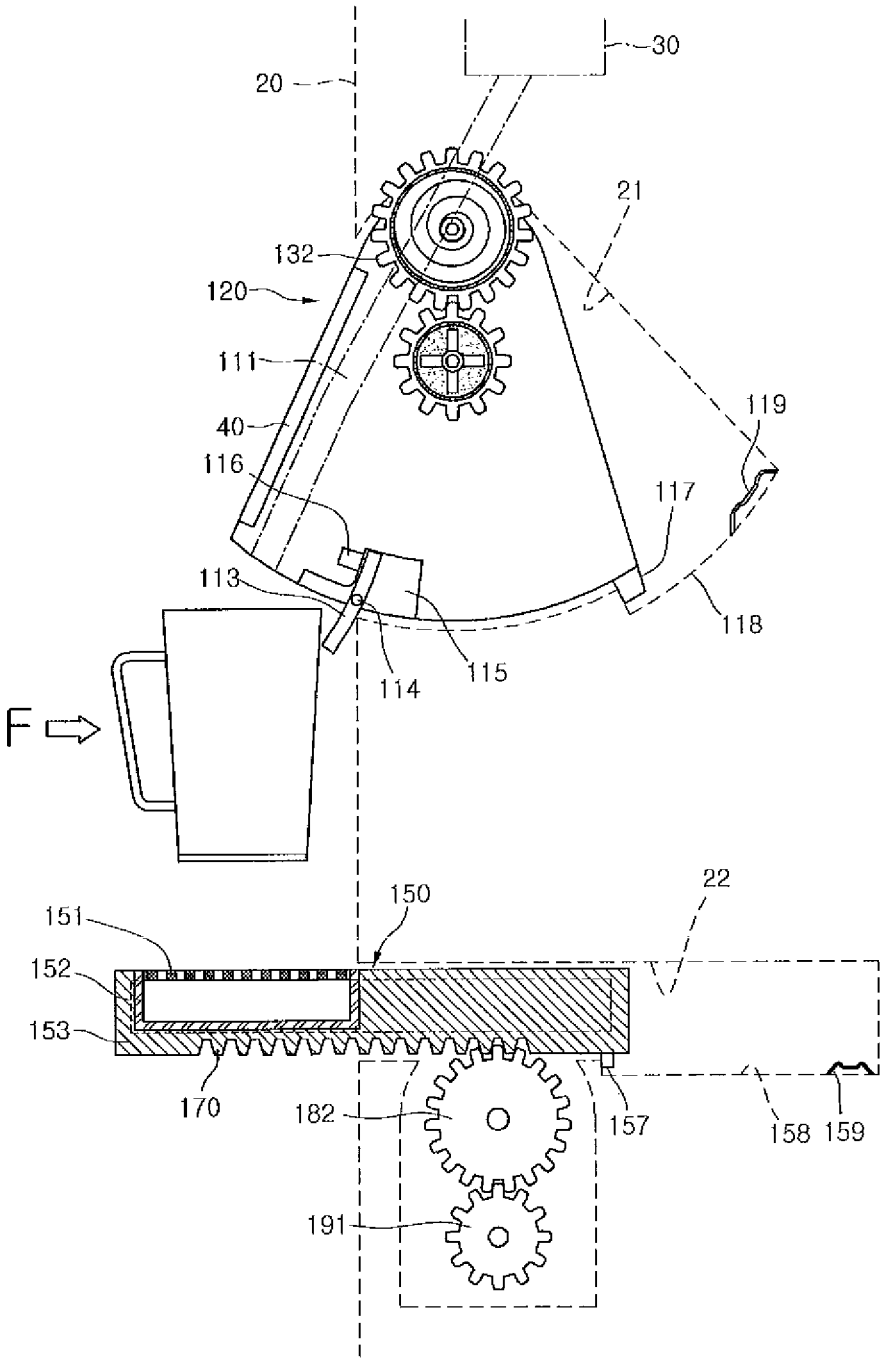
FIG. 6 is a cross-sectional view showing a dispenser and tray in a withdrawn state according to the first embodiment of the present disclosure.

FIG. 6 is a cross-sectional view showing a dispenser and tray in a withdrawn state according to the first embodiment of the present disclosure.

Referring to FIG. 6, first, when a user presses the dispenser 110 in the state shown in FIG. 5, the dispenser 110 is moved slightly rearward. Then, the protrusion 117 of the dispenser 110 presses downward against the catch 119 formed on the slot 118. When the pressing force on the dispenser 110 is removed, the dispenser 110 is pivoted by means of the elastic force generated by the elastic member 133 of the rotating unit 130. Thus, the restriction of the protrusion 117 by the catch 119 is negated.

In detail, through the action of pressing and releasing the dispenser 110, the dispenser 110 is pivoted clockwise through the biasing of the elastic member 133. Here, the rotating speed of the blade 145 of the damping unit 140 is reduced by the resistance of the viscous fluid 144. Thus, the damping gear 141 of the damping unit 140 reduces the rotating speed of the driving gear 132 of the rotating unit 130, so that the dispenser 110 is smoothly withdrawn.

When the dispenser 110 is pivoted, the protrusion 117 of the dispenser 110 moves forward in the slot 118. The pivoting continues until the protrusion 117 of the dispenser 110 catches on the front end of the slot 118. Here, the control unit 40 constituting the front surface of the dispenser 110 is angled with respect to the front surface of the door 20.

When the dispenser 110 is completely withdrawn, the dispensing lever 113 provided at the bottom of the dispenser 110 pivots about the hinge axes 114. Here, because the dispensing lever 113 is eccentrically formed about the hinge axes 114, its generated moment of rotation causes it to rotate. Thus, as shown, the lower end of the dispensing button 113 projects downward from the lower portion of the dispenser 110. In this state, when a user presses the dispensing button 113 with a cup, the dispensing button 113 rotates counterclockwise to press against the switch 116. Then, the switch 116 transmits a signal to the controller to dispense potable water, whereupon water from the water tank 30 is dispensed through the water supply tube 111. Hence, the water is dispensed through the water supply tube 111 into the cup.

After having consumed enough water, the user presses the dispenser 110 to insert the dispenser 110 back into the housing 21 formed in the door 20. Here, the protrusion 117 on the dispenser 110 catches on and is restricted by the catch 119 of the housing 21, so that the dispenser 110 is prevented from pivoting despite the rotational force imparted by the elastic member 133 of the rotating unit 130.

When the user empties the remainder of the water after consuming enough of the water from the cup, the user manipulates the tray 150 in the same manner and sequence as the dispenser 110. That is, the user presses and then releases the tray 150, so that the tray 150 is slightly pushed rearward. Then, the protrusion 157 on the tray 150 presses against the lower portion of the catch 159 and is released from its restriction by the catch 159. Then, the tray 150 is withdrawn forward by the elastic force of the elastic member 183 provided on the withdrawing unit 180.

Here, the protrusion 157 of the tray 150 moves forward in the slot 158, and when the protrusion 157 of the tray 150 catches on the front of the slot 157, the withdrawal of the tray 150 is stopped.

When the tray 150 is completely withdrawn, the grill portion 151 of the tray 150 is exposed to the outside. Thus, the user can discard the water left in the cup into the inner tray 152 through the grill portion 151. After the water is discarded in the inner tray 152 of the tray 150, the user pushes the tray 150 once more. Hence, the protrusion 157 of the tray 150 is restricted by the catch 159. When the inner tray 152 is completely filled with water, the inner tray 152 may be separated from the outer tray 153 to empty the water.

According to a user's wishes, the dispenser 110 and the tray 150 can be separately withdrawn from the door 20. Thus, because the dispenser 110 and the tray 150 are normally inserted inside the door 20, a user sustaining injury from bumping into the dispenser 110 or tray 150 while passing by the refrigerator can be prevented.

Figure 7:
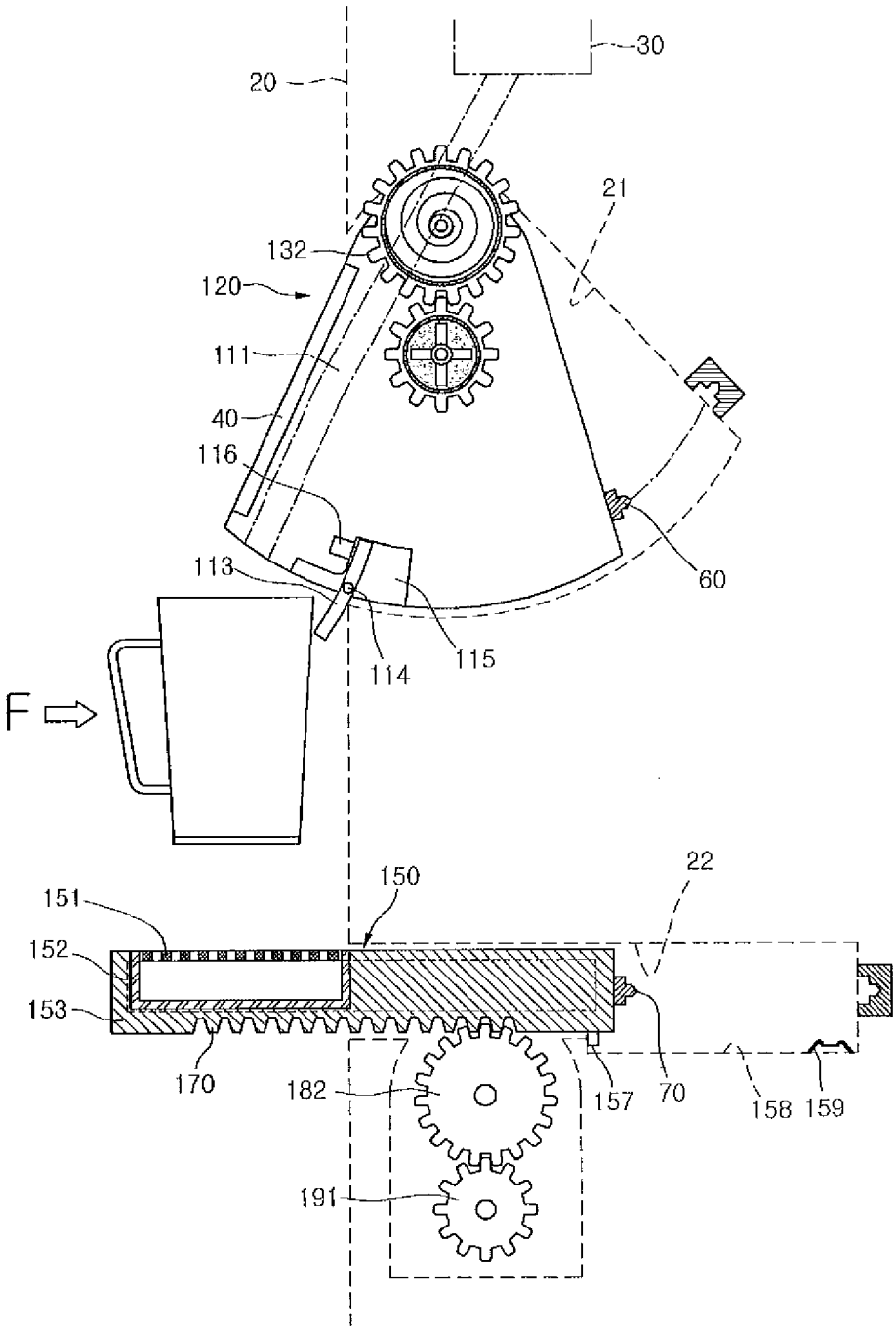
FIG. 7 is a cross-sectional view showing a dispenser and tray structure according to a second embodiment of the present disclosure.

FIG. 7 is a cross-sectional view showing a dispenser and tray structure according to a second embodiment of the present disclosure.

Referring to FIG. 7, a dispenser and tray structure according to the second embodiment of the present disclosure is configured the same as in the first embodiment except for a difference in the structure of a catching member that restricts the dispenser 110. Therefore, a description of only this portion will be provided.

In detail, while the protrusions 117 and 157 and the catches 119 and 159 have been disclosed in the description of the first embodiment as instruments for restricting the dispenser and the tray the present embodiment discloses tact switches 60 and 70 in their stead. More specifically, when the dispenser 110 or the tray 150 is pressed and released once, the restricting by the tact switch is negated; and when the dispenser 110 or the tray 150 is pressed and released once more, the tact switch resumes its restriction. Such tact switches are commonly used in tape feeding covers for cassette tape decks, covers for CD players, etc.

By employing the above tact switches 60 and 70, a user can withdraw or insert a dispenser or tray by slightly pressing and releasing the dispenser or tray.

Figure 8:
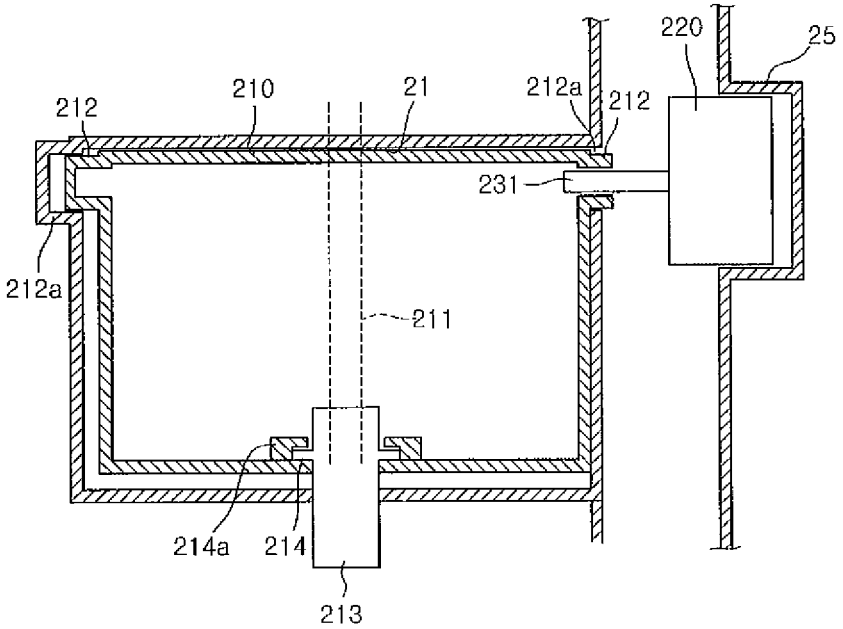
FIG. 8 is a sectional view of FIG. 1 taken along line I-I' showing a dispenser structure according to a third embodiment of the present disclosure.

FIG. 8 is a sectional view of FIG. 1 taken along line I-I' showing a dispenser structure according to a third embodiment of the present disclosure.

Referring to FIG. 8, a control unit 50 (in FIG. 10) is provided on the front surface of a dispenser 210. Also, buttons 51 and 52 (in FIG. 10) for simultaneously withdrawing and inserting the dispenser 210 and a tray 250 may be provided on the control unit 50. In addition, a withdrawing and inserting button for the dispenser 210, and a withdrawing and inserting button for the tray 250 may be separately provided on the control unit 50. A touch screen or touch buttons may be used for control unit 50. Below, a description will be given based on simultaneous withdrawal and insertion buttons 51 and 52 disposed on the control unit 50.

The dispenser 210 is pivotably coupled to the door 20 through a hinge. Here, the door defines a housing 21 for housing the dispenser 210. Also, the dispenser 210 has a hinge portion 212 formed on either side at upper portions thereof, and the door 20 defines hinge receivers 212*a* corresponding to the hinge portions 212. The dispenser 210 is thus withdrawn by being pivoted about the hinge portions 212.

A dispensing lever 213 is pivotably disposed at the lower surface of the dispenser 210. A hinge axis 214 is formed on either side of the dispensing lever 213, and hinge receivers 214*a* are formed on the lower surface of the dispenser 210, to which the hinge axes 214 are pivotably coupled. The dispensing lever 213 has the same structure as that described in the first embodiment.

A driving mechanism 220 is further provided to impart withdrawing force to the dispenser 210. The driving mechanism 220 may employ a motor that rotates to automatically withdraw and insert the dispenser 210. Here, the driving mechanism 220 may employ a motor with controllable rotational speed, in which case there is no need to install a separate damping unit for reducing the rotational speed of the driving mechanism 220. Also, the driving mechanism 220 is fixed to a fixing portion 25 defined in the door 20.

In brief, the dispenser 210 according to the third embodiment of the present disclosure is structurally the same as that of the first embodiment, with the exception of the structure of the driving mechanism 220.

Figure 9:
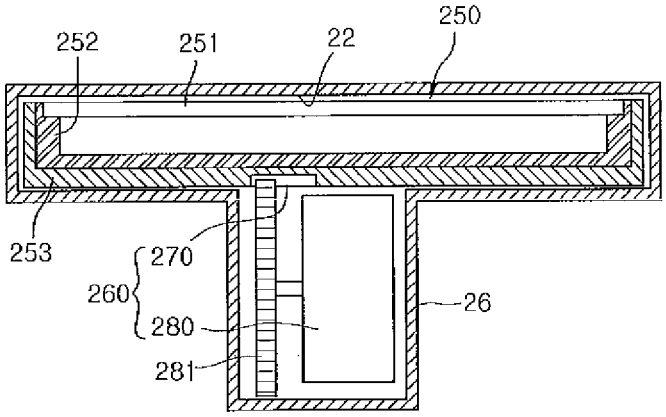
FIG. 9 is a sectional view of FIG. 1 taken along line II-II' showing a tray structure according to the third embodiment of the present disclosure.

FIG. 9 is a sectional view of FIG. 1 taken along line II-II' showing a tray structure according to the third embodiment of the present disclosure.

Referring to FIG. 9, a tray 250 is provided below the dispenser 210. The tray 250, as in the first embodiment, is configured with a grill portion 251, an inner tray 252, and an outer tray 253. The tray 250 is also provided in the door 20, to be capable of forward and rearward translation movement. The door defines a receiving space 22 to receive the tray 250. A withdrawing unit 260 for moving the tray 250 linearly back and forth is provided below the tray 250.

The withdrawing unit 260 includes a rack gear 270 defined in the tray 250 (or more specifically, in the undersurface of the outer tray 253), and a motor 280 engaged to the rack gear 270 to withdraw and insert the rack gear 270. Here, the motor 280 may be the same motor 210 that drives the dispenser 210, and may be a stepping motor. Also, the motor 280 is fixed to a fixing portion 26 formed in the door 20.

Figure 10:
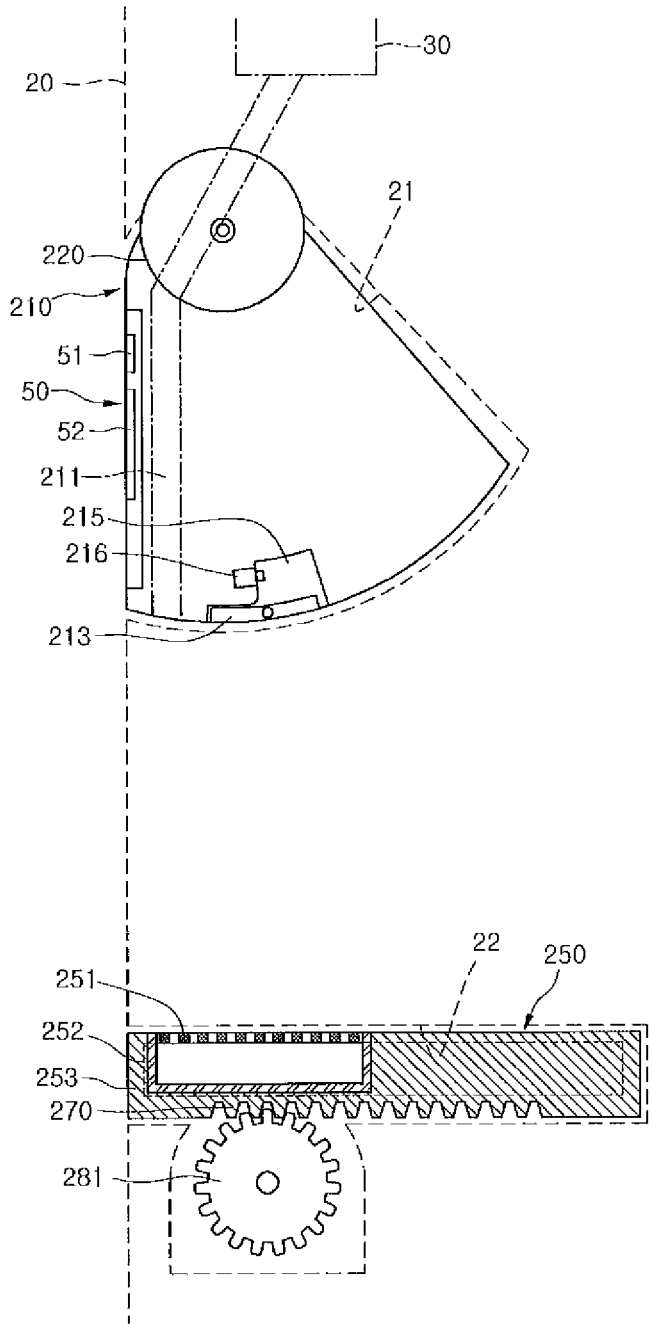
FIG. 10 is a cross-sectional view showing a dispenser and tray structure according to the third embodiment of the present disclosure.

FIG. 10 is a cross-sectional view showing a dispenser and tray structure according to the third embodiment of the present disclosure.

Referring to FIG. 10, a pivoting space 215 that allows a dispensing lever 213 to pivot therein is formed in the lower surface of the dispenser 210. Also, a switch 216 is provided at the front surface of the pivoting space 215.

There is no need to provide a separate protrusion, slot, and catch on the lower surface of the dispenser 210 and the lower surface of the tray 250 in order to restrict the withdrawn distances of the dispenser 210 and the tray 250. This is because the motor automatically withdraws and inserts the dispenser 210 and the tray 250. That is, the rotated amount of the motor may be controlled to restrict the amounts by which the dispenser 210 is pivoted and the tray 250 is withdrawn.

The operation of the above-configured dispenser and tray structures according to the third embodiment of the present disclosure will be described below.

First, when a user presses the simultaneous withdrawing button 51 on the control unit 50, the motors 230 and 280 operate, and the dispenser 210 and the tray 250 are simultaneously withdrawn. When the dispenser 210 and the tray 250 are completely withdrawn, the operations of the motors 230 and 280 cease. Here, when the dispenser 210 is completely withdrawn, the dispensing lever 213 pivots about the hinge axes 214 to project downward from the dispenser 210. In this state, when a user presses the dispensing lever 213 with a cup, the switch 216 is pressed and transmits a control signal to the controller to dispense potable water.

Next, when the user presses the simultaneous insertion button 52 for the dispenser 210 and tray 250, the motors 230 and 280 rotate in reverse directions to simultaneously insert the dispenser 210 and the tray 250 into the housing 21 and the receiving space 22.

Should a predetermined duration elapse from the point where the simultaneous withdrawal button 51 for the dispenser 210 and the tray 250 is pressed on the control unit, during which there is no subsequent pressing of the simultaneous insertion button 52, the dispenser 210 and the tray 250 may be made to automatically be inserted. In this way, even when a user forgets to insert the dispenser 210 and the tray 250, the dispenser 210 and tray 250 are automatically inserted, so that user convenience and safety are increased.

In addition, because the dispenser 210 and the tray 250 are always kept inside the door 20 when not in use, users can be prevented from sustaining injury from bumping into the dispenser 210 or tray 250 while passing by the refrigerator.

The above-configured refrigerator according to the present disclosure has the following effects.

First, when a user is not using the dispenser and tray, they are withdrawn into the door, thus preventing users from sustaining injuries by bumping into the dispenser or tray when inattentively passing in proximity of the refrigerator.

According to the present disclosure, when the dispenser and tray are not be used, they are kept withdrawn inside the door, thus preventing contamination of the water supply tube of the dispenser from impurities.

Further, because the dispenser and tray are disposed inside the door, freedom of refrigerator design is significantly increased and aesthetics can also be improved.

Any reference in this specification to "one embodiment," "an embodiment," "exemplary embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a storage compartment therein;

a door pivotably coupled to a front of the main body;

a recess which is recessed a predetermined depth from a front surface of the door, the recess having a pair of hinge receiving portions, the pair of hinge receiving portions being further recessed at both side surfaces of an upper portion of the recess;

a dispenser tiltably installed in the recess, the recess being formed in a shape to match with the dispenser;

a control unit disposed on a front surface of the dispenser, the control unit being singularly tilted with the dispenser, the control unit including a screen; and a driving mechanism supplying rotational force to the dispenser to drive the dispenser to be tilted, wherein the dispenser comprises:

a pair of hinges protruding from both side surfaces of an upper portion of the dispenser, respectively, one of the pair of hinges configured to be connected to a rotational shaft of the driving mechanism;

a water supply tube placed thereinside, and extending to a bottom end thereof;

a space recessed in a bottom surface thereof;

a dispensing lever pivotably installed in the space; and a switch formed at an inner front surface of the space;

wherein the dispensing lever is configured to be pivoted in a first direction and received in the space to be hidden when the dispenser is tilted to be inserted in the recess, wherein the dispensing lever is configured to be pivoted in a second direction, which is opposite to the first direction, when the dispenser is tilted to be withdrawn from the recess, and wherein the switch is pressed by a front upper surface of the dispensing lever, when a front lower surface of the dispensing lever is pressed in the second direction by a pressing force, in a state where the dispenser is withdrawn from the recess.

2. The refrigerator according to claim 1, wherein the front surface of the dispenser is configured to be coplanar with a front surface of the door when the dispenser is completely received in the recess.

3. The refrigerator according to claim 2, wherein the dispenser forms an angle with respect to the front surface of the door when the dispenser is tilted forward to receive water.

4. The refrigerator according to claim 1, wherein the water supply tube has a dispensing end that is exposed to an outside when the dispenser is tilted forward to receive water.

5. The refrigerator according to claim 1, further comprising:

an inner tray for storing discharged water during dispensing of potable water; and an outer tray to which the inner tray is detachably coupled.

6. The refrigerator according to claim 1, further comprising a restricting unit configured to restrict movement of the dispenser.

7. The refrigerator according to claim 6, wherein the restricting unit comprises:

a protrusion protruding from the bottom surface of the dispenser; and a catch provided on a floor of the recess.

8. The refrigerator according to claim 1, further comprising a limiting unit configured to limit the moving distance of the dispenser.

9. The refrigerator according to claim 8, wherein the limiting unit comprises:

a protrusion protruding from the bottom surface of the dispenser; and a slot configured to be stepped in a floor of the recess.

10. The refrigerator according to claim 1, wherein the driving mechanism comprises:

a rotating unit configured to impart the rotational force to the dispenser; and a damping unit configured to dampen the rotational force imparted by the rotating unit.

11. The refrigerator according to claim 10, wherein the rotating unit and the damping unit are engaged through gears.

12. The refrigerator according to claim 10, wherein the rotating unit comprises a clock spring of a tensile material.

13. The refrigerator according to claim 1, wherein when the dispenser is completely inserted into the recess, the bottom surface of the dispenser is coplanar with a rear surface of the dispensing lever.

14. The refrigerator according to claim 1, wherein the control unit comprises a touch screen or a touch button to input command for driving the driving mechanism.

15. The refrigerator according to claim 1, further comprising:

a tray provided below the dispenser to be forwardly withdrawable; and an additional driving mechanism for driving the tray.

16. The refrigerator according to claim 15, wherein the additional driving mechanism comprises:

a rack gear defined in an undersurface of the tray;

a withdrawing unit engaged with the rack gear, to withdraw or insert the tray; and a damping unit configured to dampen withdrawing force of the withdrawing unit.

17. The refrigerator according to claim 16, wherein the withdrawing unit and the damping unit are engaged through gears.

18. The refrigerator according to claim 15, further comprising a restricting unit configured to restrict movement of the tray.

19. The refrigerator according to claim 18, wherein the restricting unit comprises:

a protrusion protruding from a bottom of the tray; and a catch provided on the floor of a space in which the tray is received.

20. The refrigerator according to claim 15, further comprising a limiting unit configured to limit the moving distance of the tray.

21. The refrigerator according to claim 20, wherein the limiting unit comprises:

a protrusion protruding from a bottom of the tray; and a slot defined to be stepped in the floor of a space in which the tray is received.

* * * * *